US011738442B2

(12) United States Patent
Cluthe

(10) Patent No.: US 11,738,442 B2
(45) Date of Patent: Aug. 29, 2023

(54) MULTIPLE BIT HAND TOOL

(71) Applicant: RETRACT-A-BIT INC., Kitchener (CA)

(72) Inventor: Gary Paul Cluthe, Waterloo (CA)

(73) Assignee: RETRACT-A-BIT INC., Kitchener (CA)

( * ) Notice: Subject to any disclaimer, the term of this patent is extended or adjusted under 35 U.S.C. 154(b) by 192 days.

(21) Appl. No.: 17/029,278

(22) Filed: Sep. 23, 2020

(65) Prior Publication Data

US 2021/0001469 A1 Jan. 7, 2021

Related U.S. Application Data

(62) Division of application No. 15/032,681, filed as application No. PCT/CA2014/051036 on Oct. 28, 2014, now abandoned.

(60) Provisional application No. 61/896,501, filed on Oct. 28, 2013.

(51) Int. Cl.

| | |
|---|---|
| ***B25G 1/08*** | (2006.01) |
| ***B25F 1/02*** | (2006.01) |
| ***B25F 1/04*** | (2006.01) |

(52) U.S. Cl.

CPC ..... *B25G 1/085* (2013.01); *B25F 1/02* (2013.01); *B25F 1/04* (2013.01); *B25G 1/08* (2013.01)

(58) Field of Classification Search

CPC ... B25G 1/085; B25G 1/08; B25F 1/02; B25F 1/04; B25B 15/02; B25B 15/005; B25B 15/008; B25B 23/00; B25B 23/16; Y10T 483/1798

See application file for complete search history.

(56) References Cited

U.S. PATENT DOCUMENTS

| | | | | |
|---|---|---|---|---|
| 5,325,745 A * | 7/1994 | Koehler | B25F 1/04 | 81/439 |
| 6,332,384 B1 * | 12/2001 | Cluthe | B25G 1/085 | 81/439 |
| 8,806,991 B2 * | 8/2014 | Grand | B25B 23/16 | 81/439 |
| 2005/0045002 A1 * | 3/2005 | Cluthe | B25B 23/0035 | 81/177.85 |
| 2006/0201291 A1 * | 9/2006 | Cluthe | B25F 1/04 | 81/439 |

FOREIGN PATENT DOCUMENTS

| | | | |
|---|---|---|---|
| CA | WO 2011/079368 | * | 7/2011 |
| DE | 9006993 | | 10/1990 |
| WO | 2011079368 A1 | | 7/2011 |

OTHER PUBLICATIONS

European Search Report dated Sep. 9, 2020 for European Application No. 20 02 0290.

* cited by examiner

*Primary Examiner* — Robert J Scruggs
(74) *Attorney, Agent, or Firm* — Gowling WLG (Canada) LLP

(57) ABSTRACT

The disclosure is directed at a multiple bit hand tool which includes a handle portion and a body portion. The multiple bit hand tool also includes a chuck portion with an improved locking collar for locking the tool bit in place when it is in an extended position. The locking collar includes a latch portion with a set of latch arms each having a bit end cap contact and a release cam contact for abutting the tool bit and an associated actuation mechanism.

11 Claims, 12 Drawing Sheets

MULTIPLE BIT HAND TOOL

CROSS-REFERENCE TO RELATED APPLICATIONS

This application claims the benefit of priority of U.S. Provisional Patent Application No. 61/896,501 filed Oct. 28, 2013 and is a divisional of U.S. patent application Ser. No. 15/032,681 filed Oct. 28, 2014, which are hereby incorporated by reference.

FIELD

The present application relates generally to hand tools. More particularly, the present disclosure relates to a multiple bit (multi-bit) hand tool.

BACKGROUND

The use of hand tools has been around for many generations. Over the years, these hand tools have evolved to include different versions or updated versions of previous embodiments. For instance, hand tools, such as screwdrivers, are now available as multiple bit, or multi-bit, tools whereby one tool may be easily transformed into multiple tools. In one embodiment, a multi-bit tool may provide the functionality of six screwdrivers of different size and type.

Multi-bit tools are continually being improved in order to, not only, facilitate use but also to increase the longevity of the tool.

Therefore, there is provided a novel multiple bit hand tool.

SUMMARY

It is an aspect of the disclosure to provide a hand tool having a suitable means for automatically locking the bits or tool elements in their operative position, once extended to that position, and a suitable means for readily unlocking the tool elements when retraction is desired.

It is an aspect of the disclosure to provide a hand tool or screwdriver of the general type referred to above, but having a suitable means for automatically extending or retracting tool elements.

In a first aspect, the present disclosure provides a multiple bit hand tool including a handle body having a chuck, a plurality of tool elements housed within the handle body and extendable and retractable by an actuator, and a locking mechanism in the chuck for locking a selected one of the tool elements in an extended position, wherein the locking mechanism includes a latch for retaining the tool element in the extended position and a release cam for removing the latch from retaining the tool element wherein the release cam is actuated by the actuator.

In a second aspect, the present disclosure provides a multiple bit hand tool including a handle body and a plurality of tool elements housed within the handle body and extendable and retractable by an actuator having a spring driven mechanism, wherein the spring driven actuation mechanism is housed within the handle body and extends and retracts any one of the plurality of tool elements.

In another aspect, the present disclosure provides a multiple bit hand tool including a handle body having a chuck, a plurality of tool elements housed within the handle body and extendable and retractable by an actuator having a spring driven mechanism, and a locking mechanism in the chuck for locking a selected one of the tool elements in an extended position, wherein the locking mechanism includes a latch for retaining the tool element in the extended position and a release cam for removing the latch from retaining the tool element, wherein the release cam is actuated by the actuator and wherein the spring driven actuation mechanism is housed within the handle body and extends and retracts any one of the plurality of tool elements.

In an aspect, the present disclosure provides a multiple bit hand tool as generally and specifically described herein.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Generally, the present disclosure provides a multiple bit (multi-bit) hand tool. The multi-bit hand tool includes a handle portion and a body portion which are in a friction-fit relationship which reduces the number of parts necessary to manufacture the multi-bit hand tool. In another embodiment, the multi-bit tool includes a locking collar which includes an improved locking mechanism to hold a tool in place when in use. These will be described in more detail below.

Figure 1:
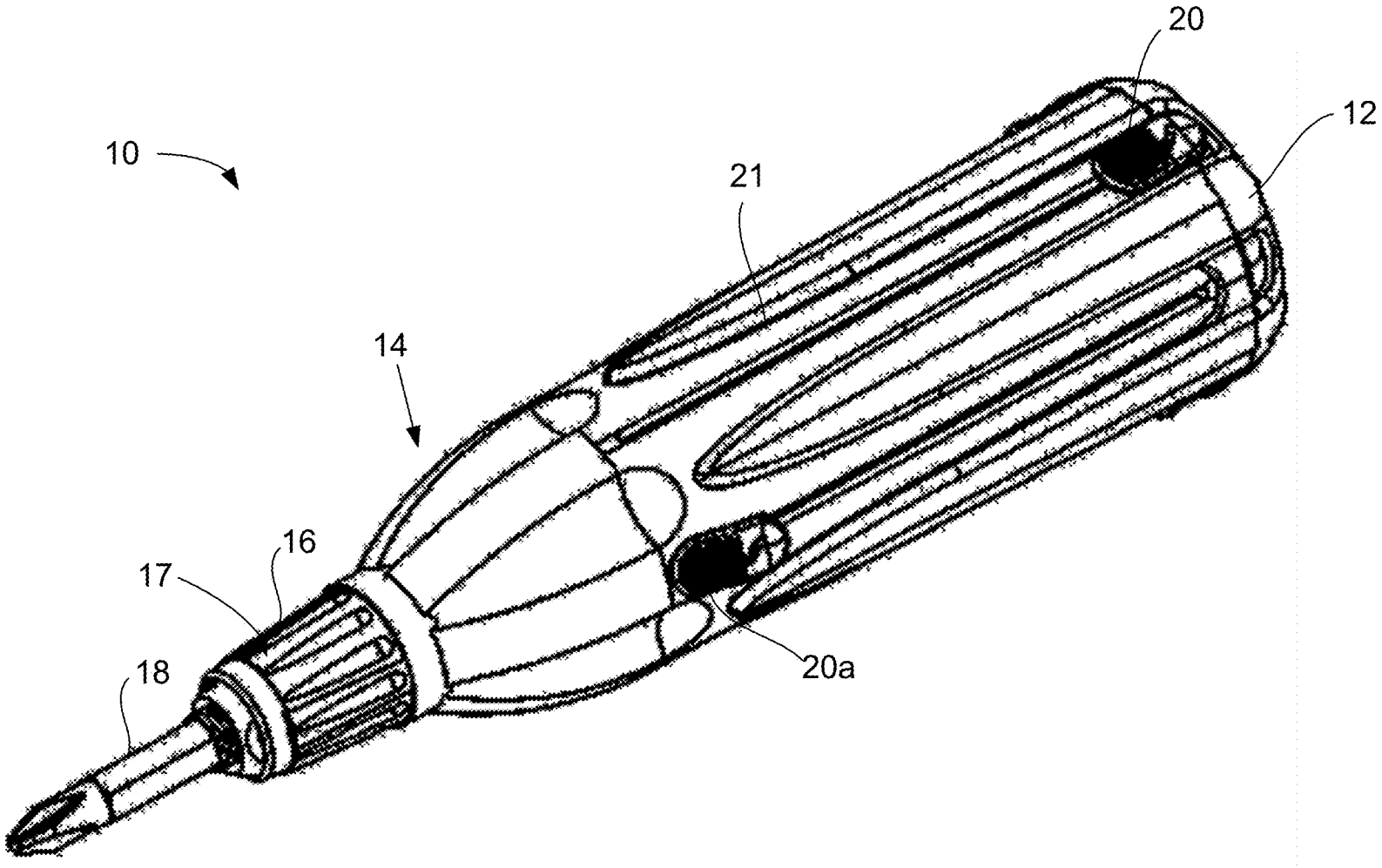
FIG. 1 is a perspective view of a multiple bit hand tool, in accordance with an embodiment.

Turning to FIG. 1, a perspective view of a multi-bit hand tool is shown. The multi-bit hand tool 10 includes a handle portion 12 and a body portion 14. The body portion 14 includes a chuck, or chuck portion, 16 which includes an opening allowing one of a set of tool elements or bits 18 (typically housed within the tool 10) to be extended out of the tool 10 for use. The tool bit 18 is locked in place by a locking collar 17 which is part of the chuck portion 16. The set of tool elements or bits 18 are generally housed within the tool 10 until one of the set of tool bits 18 is actuated via an actuating mechanism 20 to extend the tool bit 18 through the chuck portion 16. When the body portion 14 is connected to the handle portion 12 (as described in more detail below), a set of slots 21 for receiving the actuating mechanism 20 is created within which individual actuating mechanisms 20 may slide causing the tool bit 18 to both be extended through the chuck portion and also retracted from the chuck portion 16.

As shown in FIG. 1, one of the tool bits 18 is extended through the chuck via the actuating mechanism 20*a*.

Figure 2B:
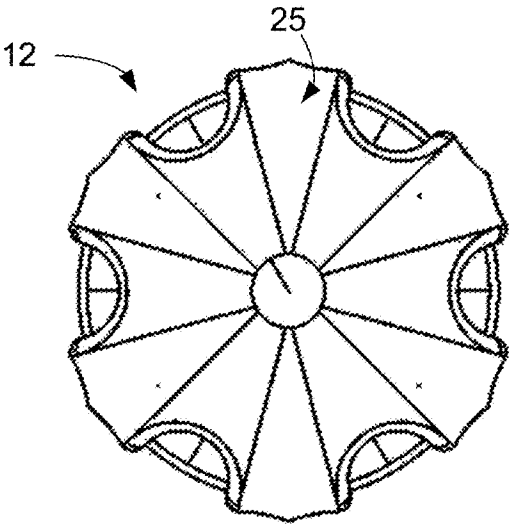
FIGS. 2A, 2B, and 2C are side, end, and perspective views, respectively, of a handle portion of the hand tool of FIG. 1.
Figure 2A:
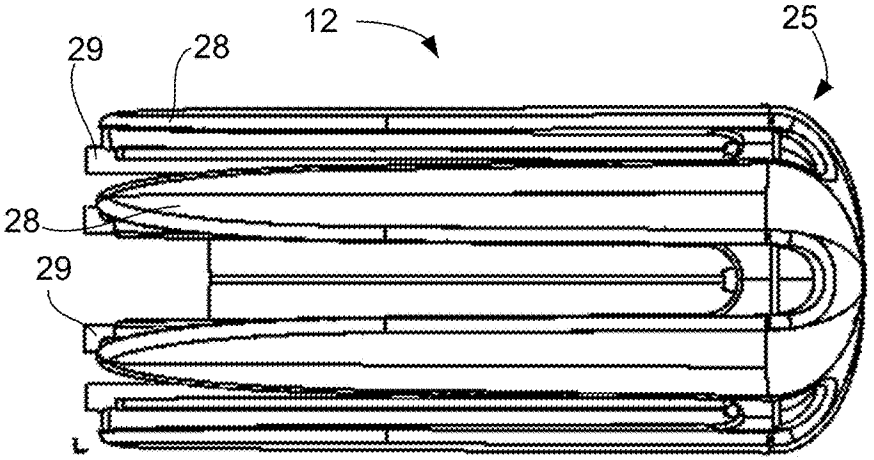
Figure 2C:
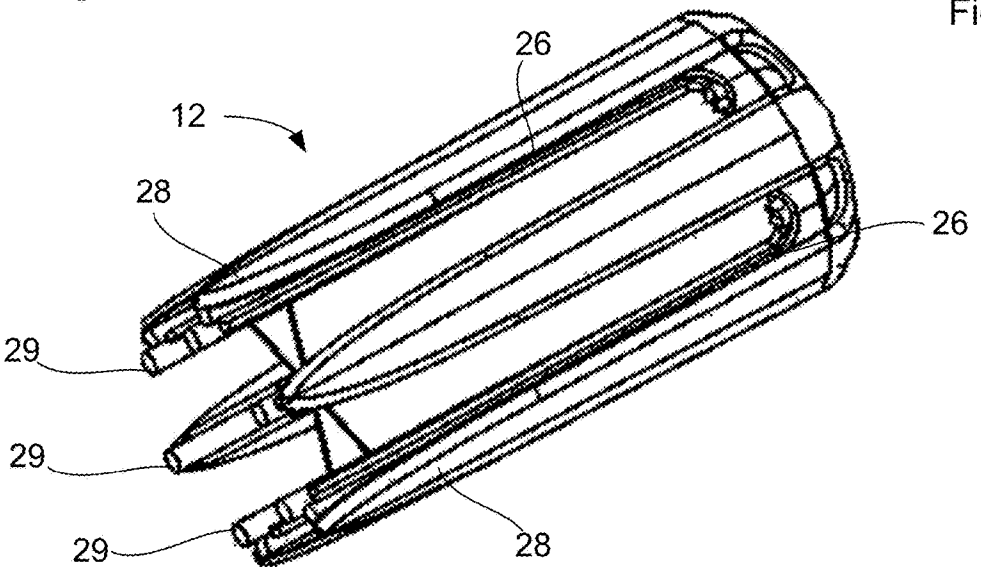
Figure 3B:
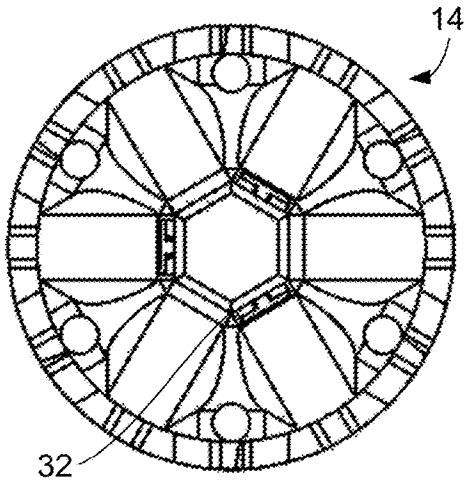
FIGS. 3A, 3B, 3C, and 3D are side, inside end, front end, and perspective views, respectively, of a body portion of the hand tool of FIG. 1.
Figure 3A:
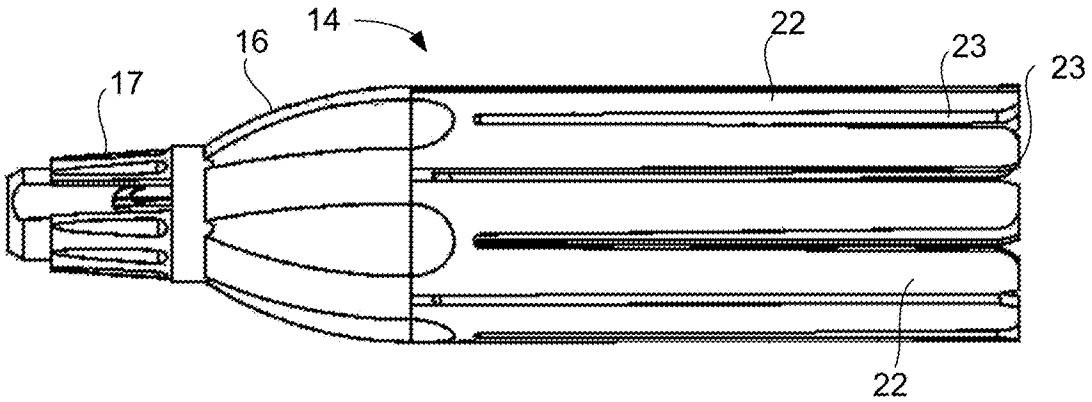
Figure 3D:
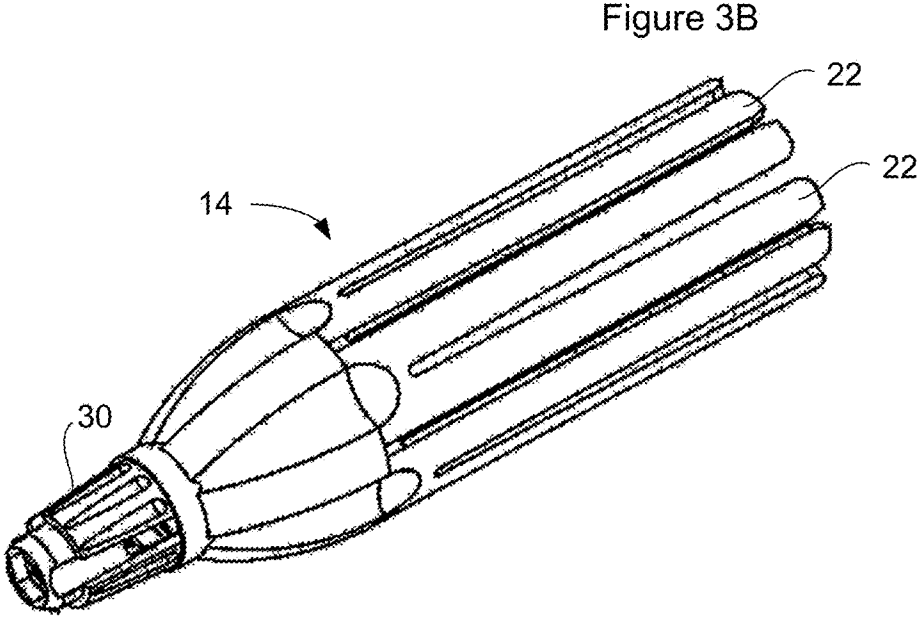
Figure 3C:
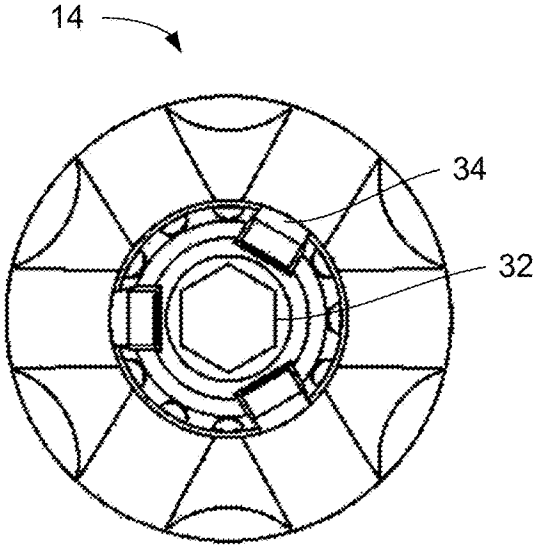

Turning to FIGS. 2A to 2C, a side view, an end view and a perspective view of the handle portion 12 is shown. As more clearly shown in these Figures, the handle portion 12 includes a cap portion 25 which serves as a cover for one end of the tool, namely the end away from the chuck portion 16. Extending out from the cap portion 25 are a plurality of slats 28 extend therefrom. Individual prongs 29 which serve as support are also mounted to the cap portion 25 and extend away from the cap portion 25. Each slat 28 includes a groove 26 on either side of the slat 28 to receive corresponding protrusions or tongues which are part of the body portion 14 to provide a friction fit handle for the tool 10.

Turning to FIGS. 3A to 3D, a side view, an end view, a front view and a perspective view of a first embodiment of a body portion 14 is shown. As discussed above, the body portion 14 includes a chuck portion 16 over which the locking collar 17 is placed to assist in locking the tool bit (not shown) when the tool bit is extended through the chuck. In the current embodiment, it is preferred that the chuck portion is formed as an integral part of the body portion 14, however, it may also be a separate piece. The body portion 14 further includes a central opening 32 within the chuck portion 16 for receiving the tool bit 18 when it is extended through the chuck portion 16 as selected or actuated by a user. As will be understood, the tool bit 18 is also retracted through the same central opening 32 after the user is finished using the tool bit. In use, the chuck portion 16 reduces or prevents rotation of the tool bits by virtue of its central opening 32 and/or the chuck portion 16 having a cross-section (hexagonal for example) corresponding dimensionally to a cross-section of the tool bit 18. The locking collar 17 also contributes to this reduction of rotation.

The body portion 14 further includes a set of flanges 22 extending away from the locking collar 17. The flanges 22 include protrusions or a tongue portion 23 for mating with the grooves in the handle portion 12. More specifically, in a preferred embodiment, a pair of flanges 22 fit between two slats of the handle portion and are slidably connected and in a friction fit relationship with the slats thereby providing the slot in which the actuating mechanism slides and a friction-fit handle.

Figure 4A:
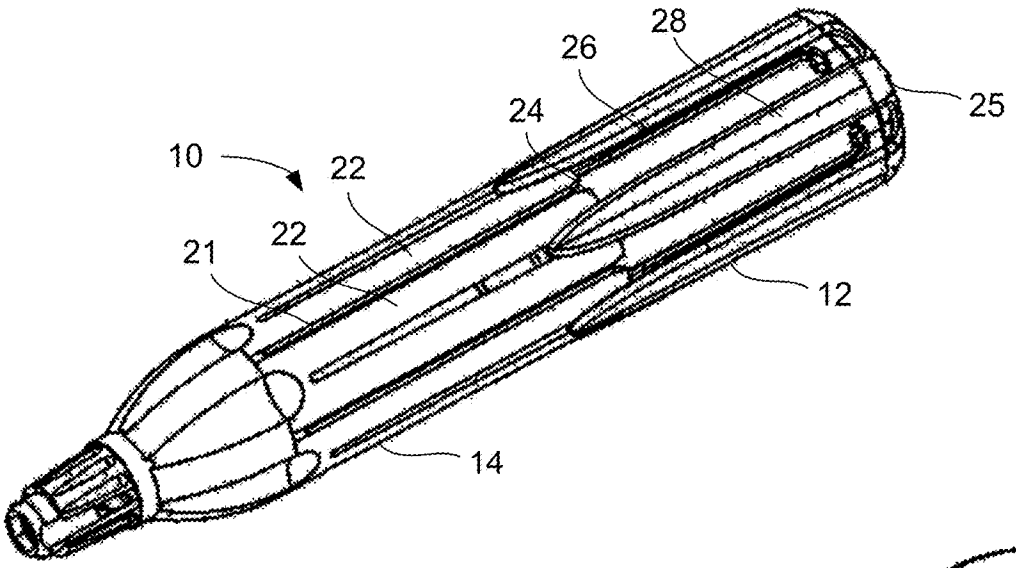
FIG. 4A is a schematic view of the handle portion and the body portion partially connected.

Turning to FIG. 4A, a perspective view of the handle portion 12 and the body portion 14 in partial connection is shown. As shown, a pair of flanges 22 of the body portion 14 fit between two slats 28 of the handle portion 12 and provide the slot 21 therebetween the two flanges 22 within which the actuation mechanism (not shown) resides and slides. As discussed above, protrusions on the surface of the flanges 22 mate with grooves within the slats 28 in order to provide a friction fit between the body portion 14 and the handle portion 12. In an alternative embodiment, the protrusions may be a part of the handle portion 12 while the grooves are part of the body portion 16. In either embodiment, the connection between the protrusions and the grooves provides for a friction fit handle and body for the hand tool 10. Although not shown in FIGS. 4A and 4B, an individual actuating mechanism (as more clearly shown in FIG. 5) for each tool bit is located in each slot created between the two flanges 22 and the pair of slats 28. When fitted together, the body portion 14 and the handle portion 12 may also form a container for housing components of the tool 10 such as, but not limited to tool bits 18.

Figure 4B:
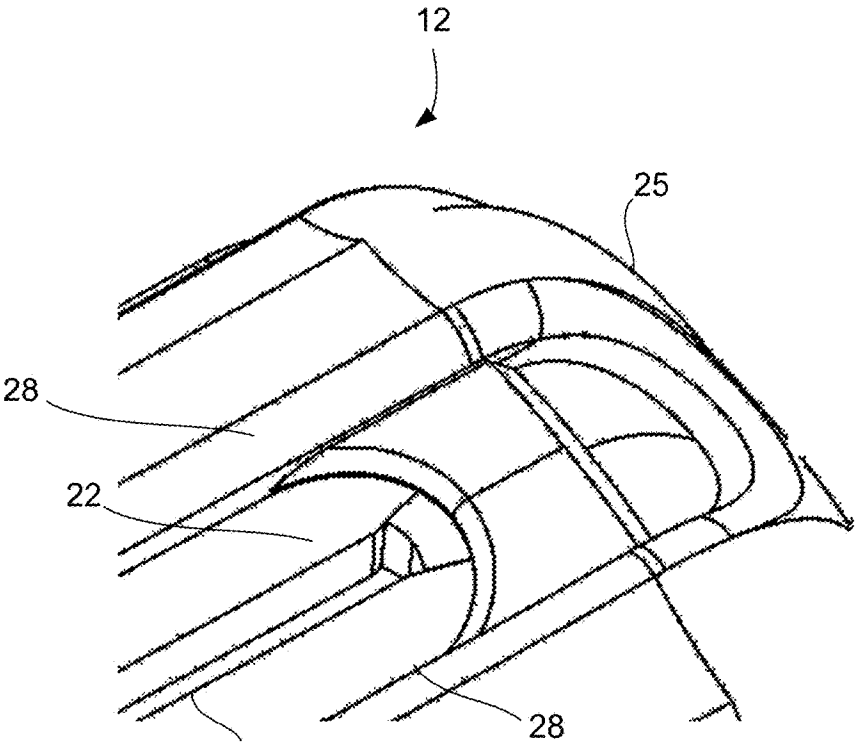
FIG. 4B is an enlarged view of a cap end of the handle portion.

FIG. 4B is an enlarged view of an end of the handle portion. As shown, the cap portion 25 provides a base for the handle portion 12 and the connection between the flanges 22 and the slats 28 is shown in more detail.

Figure 5C:
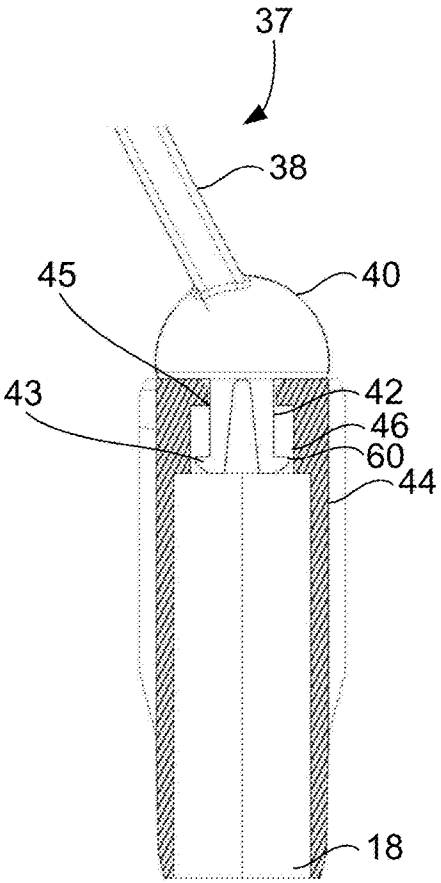
FIGS. 5A, 5B, and 5C are perspective, assembly, and cross-section views, respectively, of an actuator mechanism.
Figure 5A:
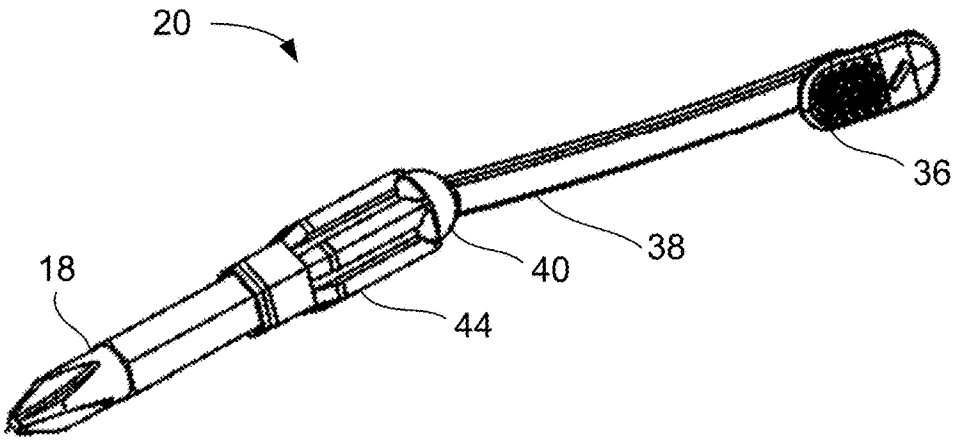
Figure 5B:
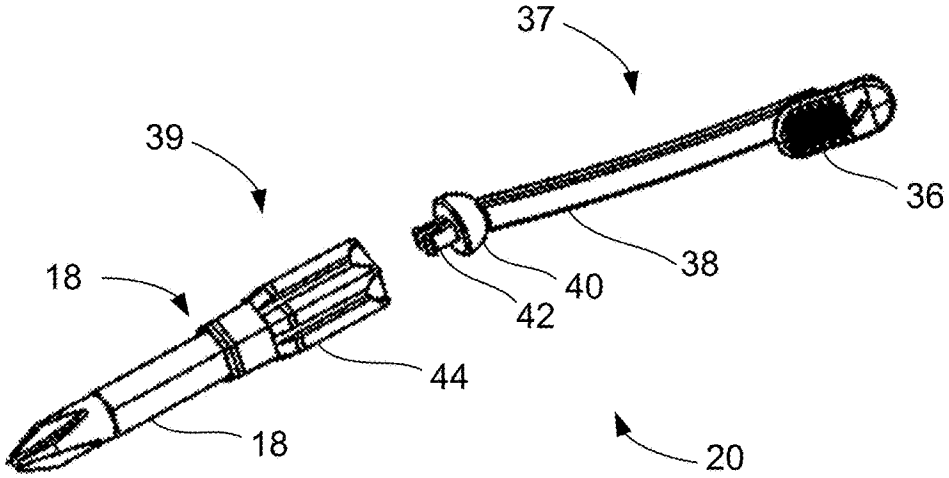

Turning to FIGS. 5A to 5*c*, various views of an actuation member 20 including a tool bit 18 are provided. FIG. 5*a* is a perspective view of the actuation member and the tool bit connected, FIG. 5*b* is a perspective view of the actuation member and the tool bit disconnected and FIG. 5*c* is an enlarged view of a joint within the actuation member.

The actuation member includes an arm portion 37 and a tool bit portion 39. The tool bit portion includes a bit end cap 44 which houses the tool bit 18. The arm portion 37 includes an actuator button 36 at one end, a connecting rod 38 and a release cam 40 connected to a set, preferably a pair, of release cam arms 42.

As more clearly shown in FIG. 5C, the release cam 40 is attached to the bit end cap 44 which serves, in some manners, as an extension of the tool bit 18. The bit end cap 44 is preferably moulded such that the tool bit 18 is firmly fitted within the bit end cap 44. The tool bit 18 located within a bit end cap 44 which includes a cavity portion 46 which receives the release cam arms 42 when connected. The release cam arms 42 each include a tab 43 to provide protection from the release cam arms 42 accidently releasing from the bit end cap 44. As will be understood, in order to release the arm portion 37 from the bit portion 39, one would have to press the release arms 42 towards each other to ensure that the tabs 43 can pass by an opening 45 at the end of the bit end cap 44.

The connection between the release cam arms 42 and the cavity 46 allows for movement of the connecting rod 38 with respect to the tool bit 18 and vice versa. This movement assists in allowing the tool bit 18 to be extended through and retracted from the chuck. The release cam 40 assists in translating the pressure applied to the actuation button into a force to either extend or retract the tool bit.

In operation, when a user applies a pressure to the actuator button 36, the button slides along the associated slot 21. By applying this pressure, a user may extend the tool bit out for use or may retract the tool bit for storage.

The joint produced by the connection between the cam and the bit cap end provides the necessary flexibility for the actuation mechanism to move along the slot (as described below).

Figure 6B:
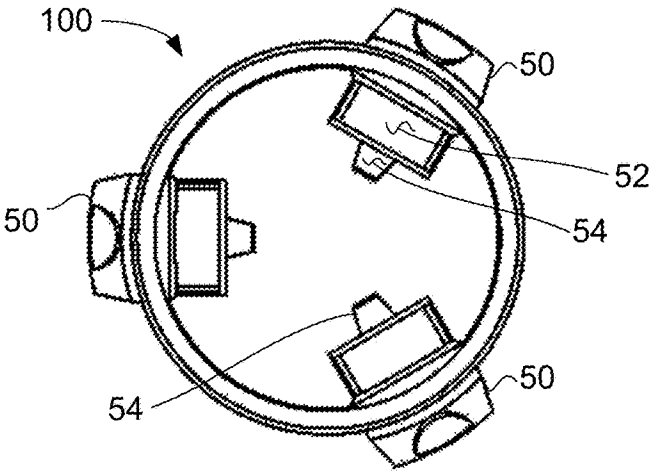
FIGS. 6A, 6B, 6C, and 6D are side, front end, inside end, and assembly views, respectively, of a latch portion.
Figure 6D:
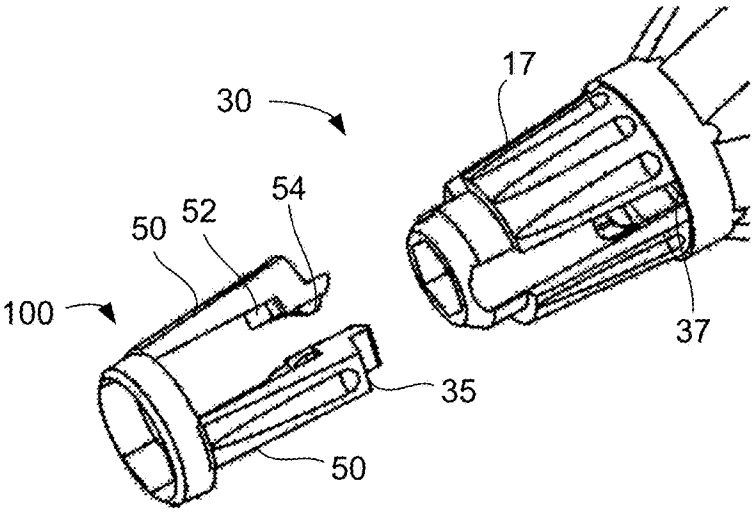
Figure 6A:
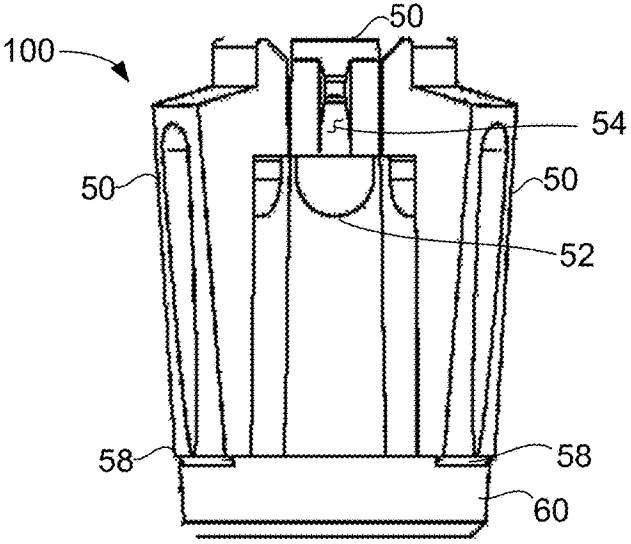
Figure 6C:
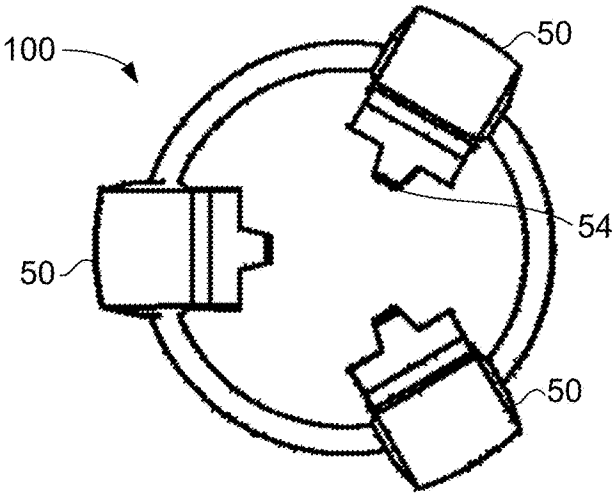
Figure 7A:
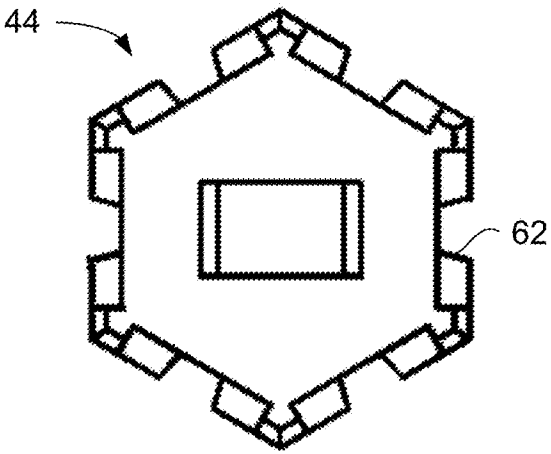
FIGS. 7A, 7B, and 7C are inside end, front end, and side views, respectively, of a bit end cap.
Figure 7B:
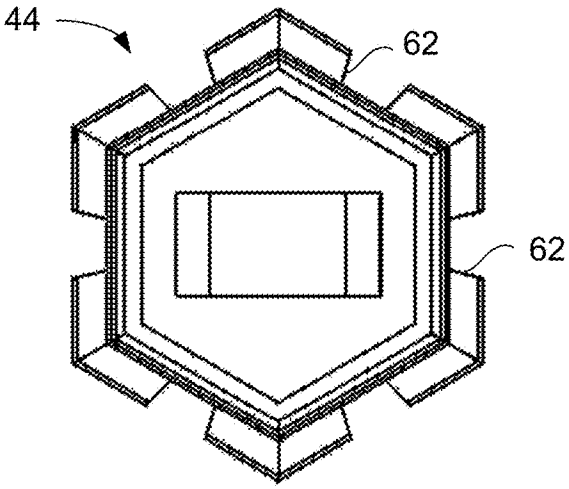
Figure 7C:
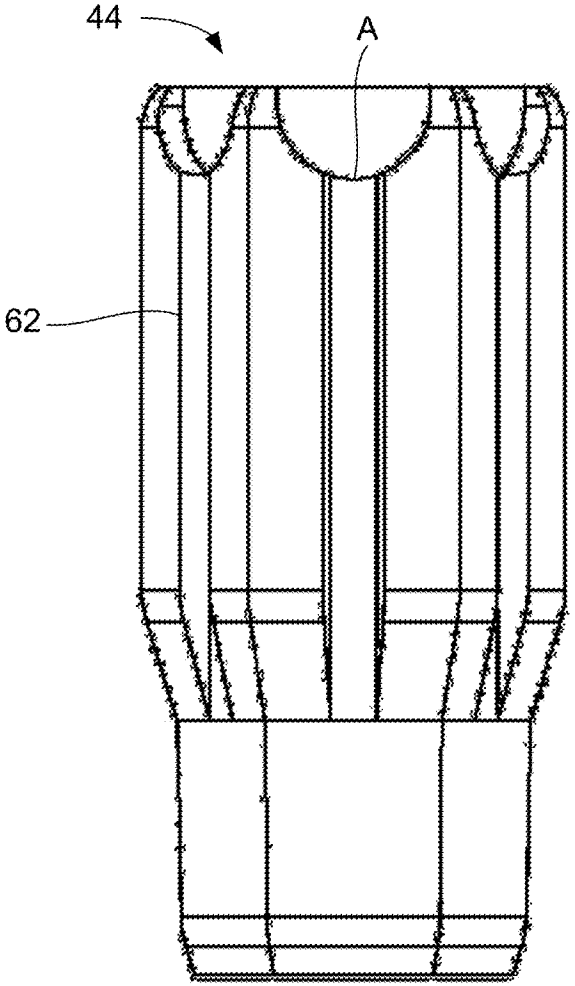

Turning to FIGS. 6A to 6C, various views of a latch portion for use with the locking collar are shown. FIG. 6*a* is a side view of the latch portion, FIG. 6B is a top view and FIG. 6C is a bottom view. FIG. 6D is perspective view of the latch mating with the locking collar.

Figure 8:
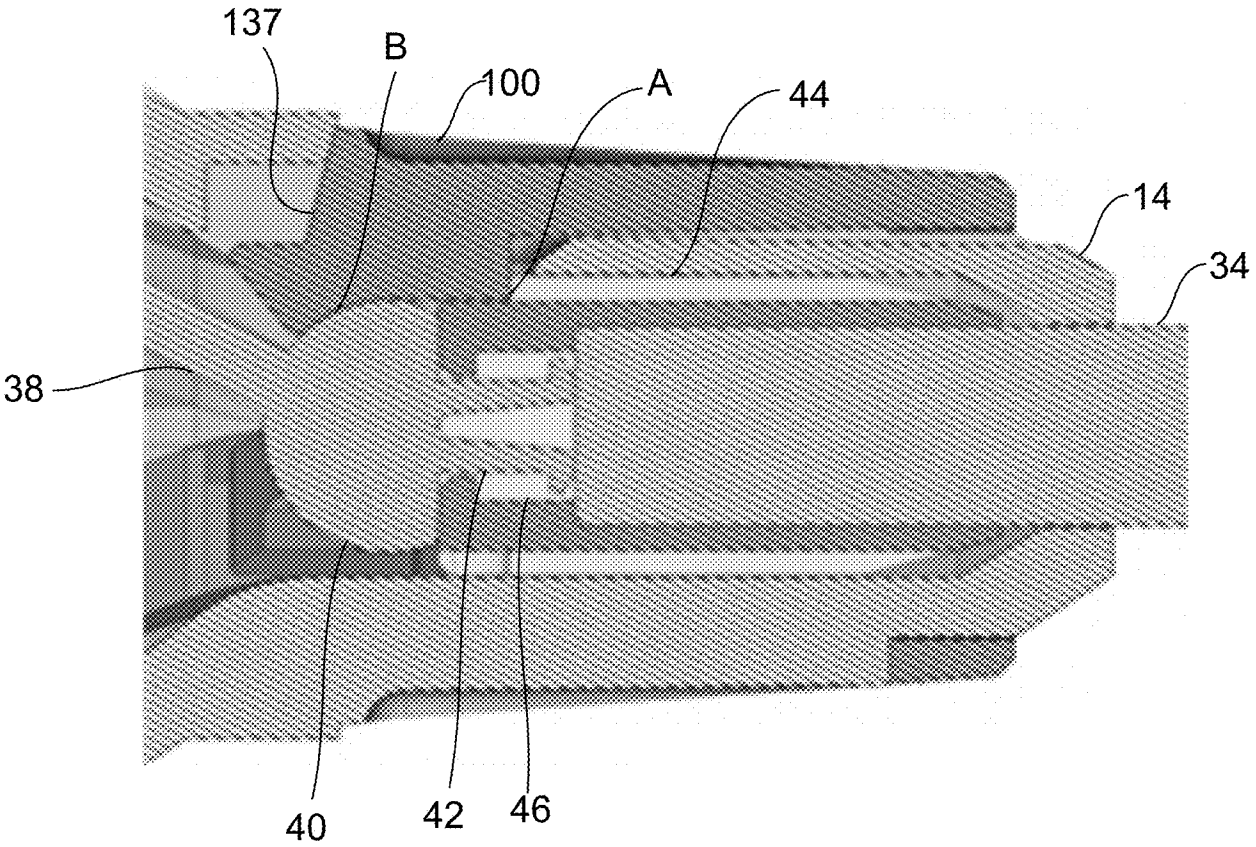
FIG. 8 is a cross section view of a locking mechanism.

As shown in FIG. 6A, the latch portion 100 includes a set of latch arms 50, which in the present embodiment is three (3), that are flexible and biased inward. Each latch arm 50 has a bit end cap contact 52 and a release cam contact 54 for initiating and enabling retraction of the tool bit when required or requested by the user. When the tool bit is in the extended position, the bit end cap contact 52 engages the bit end cap 44 at a position A (as shown in FIG. 8) and the cam contact engages the release cam 40 at a position B (as shown in FIG. 8). As the tool bit passes by the latch portion when being either extended or retracted, the arms 50 pivot slightly about their connection 58 to a cap portion 60 of the latch portion. Further details of the latch portion of the locking collar are shown in FIGS. 6*b* and 6*c*.

As shown in FIG. 6D, when the latch portion is attached to the locking collar, the arms fit within apertures in the locking collar and are preferably snapped into place. This is shown in more detail in FIG. 8.

As shown in FIG. 8, which is a cut away view of the chuck portion with a tool bit in the extended position, in order to lock the tool bit in place after it has been extended out of the chuck portion, (or past the lower end of the latch portion 100), there is contact at points A and B between the latch portion 100 and the bit end cap 44 which reduce the likelihood or prevent the tool bit from being retracted unless pressure is placed on the actuating mechanism. This provides protection against the accidental retraction of the tool bit, especially during use. As shown, in the extend position, the release cam is ushered forward by the pressure applied to the actuation mechanism (when moving the actuation mechanism 20 from the cap portion 25 towards the chuck portion 16) and the release arms 42 provide a force to extend the tool bit forward. The bit end cap 44 acts as a stop to the cam release so that the tool bit is not extended too far out of the chuck.

Each tool element 18 connects a bit to the actuating mechanism 20 with a bit end cap 44. The bit end cap 44 has a bit end cap cavity 46 at its proximal end. The bit end cap 44 is slidably connected to the actuating mechanism 20 via the connecting rod 38. The connecting rod 38 has a release cam 40 for engaging with the bit end cap 44. The release cam 40 includes release cam arms 42 which are inserted into and slidably engage with the bit end cap cavity 46 and the release cam arms 42 slidably move into and out of the bit end cap cavity 46. The release cam arms 42 remain within the bit end cap cavity 46 by retaining elements 60 at the ends of the release cam arms 42. The bit end cap 44 is retained in the locking collar 17 by the latch portion 100.

In operation, when the tool element or bit 18 is being extended, the user pushes the actuator button 36 of the actuating mechanism 20 forward. As will be understood, the pressure applied to the button causes the tool bit 18 to slide internally into the chuck portion 16 and then extend out through the opening or aperture 36. A front surface of the release cam 40 (and/or the release cam arms 42) contacts on a back surface of the bit end cap 44 to slide the tool bit 18 into the opening. Once the tool element 18 is extended, the latch arms 50, at point A, contact the bit end cap 44 and protect against retraction of the tool bit 18. In the extended position (as shown in FIGS. 1 and 8), the tool element 18 may receive an axial force which is transferred to the handle of the tool when the tool bit 18 is in use.

The latch arms 50 have a latch angled surface which corresponds to a chuck angled surface 37 on a surface of the chuck 16. When there is a rearward axial force applied on the tool bit 18, the force is transmitted through the bit end cap 44 and onto the latch arm 50, pushing the latch angled surface onto the chuck angled surface 37, and thereby causing the latch arm 50 to move inward towards and tightening the contact with the bit end cap 44 and release cam 40.

To retract the tool bit 18, the release cam 40 is slid rearward within the back of the bit end cap 44, by pressing rearwardly on the actuator button 36. The rearward movement of the actuator button 36 pulls the connecting rod 38 and the release cam 40 rearward. The rearward movement of the release cam 40 pushes the latch portion 100 outward at B thereby removing the contact at point A and allowing the bit end cap 44 and tool element 18 to retract into the handle portion 12. The travel length of the release cam arms 42 within the bit end cap cavity 46 is such that the back surface B of the release cam 40 pushes the latch arms 50 radially out enough to remove the contact at A.

The too bit 18 and the bit end cap 44 may be integrally formed, however, where the bit 18 and the bit end cap 44 are separate components, they are in a torque transmitting relationship. For example, the bit may include a keyed notch which corresponds to a keyed slot of the bit end cap 44. The bit end cap 44 may be, for example, pressed on or overmolded to the bit 18.

The bit end cap 44 may have grooves/guides 62 such that when the actuator button 36 pushes the connecting rod 38 forward the bit end cap 44 is guided by corresponding grooves/guides on the inner surface of the latch portion 100 into the central opening 36.

The release cam arms 42 may be flexibly biased away from each other such that when the release cam arms 42 are inserted into the bit end cap cavity 46 the release cam arms 42 flex enough to get through the opening in the bit end cap cavity 46. Once the release cam arms 42 are in the bit end cap cavity 38, the release cam arms 42 are retained by in the bit end cap cavity 38.

In the current disclosure, an advantage of the disclosure is that the multiple bit hand tool 10 may simplify the number and type of component parts thereby reducing cost. The multiple bit hand tool 10 may have a simplified manufacture and assembly and a reduction or elimination of mechanical fasteners (e.g., threaded fasteners). Another advantage is that the locking collar may allow for one handed extension and retraction with a hands-free chuck based locking collar.

The multiple bit hand tool 10 may also be able to house longer tool bits 18 as the components of the actuating mechanism 20 may be more compact in length. Longer tool bits 18 may provide a user with access to increased hole depth. Alternatively, the handle body 12 may be shortened as the components of the actuating mechanism 20 providing a compact multiple bit hand tool 10.

As will be understood, FIGS. 1-8 illustrate one way in which the locking collar could be installed. This disclosure is not limited to this specific configuration.

Figure 9:
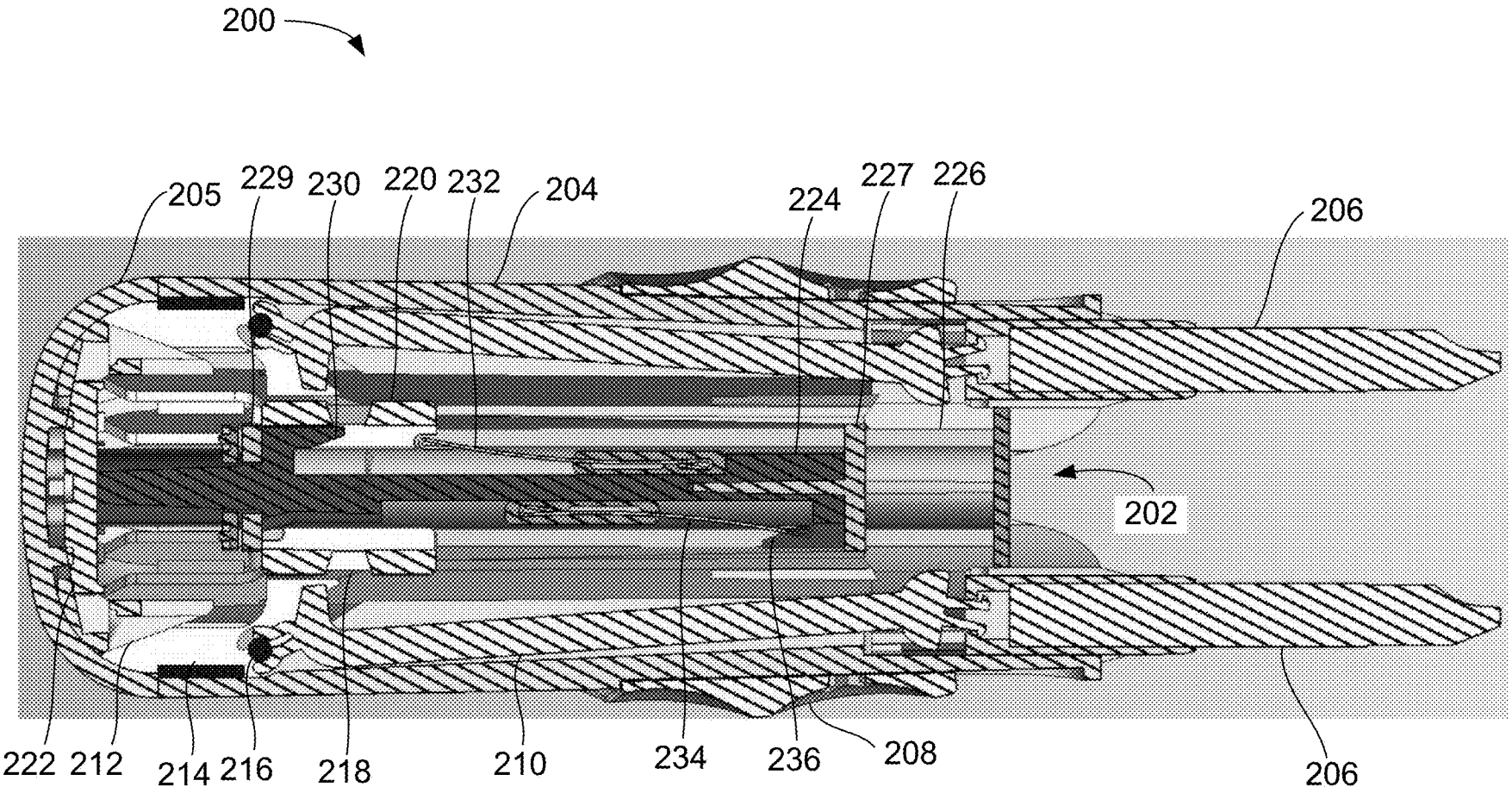
FIG. 9 is a cross-section view of a spring driven actuation mechanism for a multiple bit hand tool in a retracted position.
Figure 10:
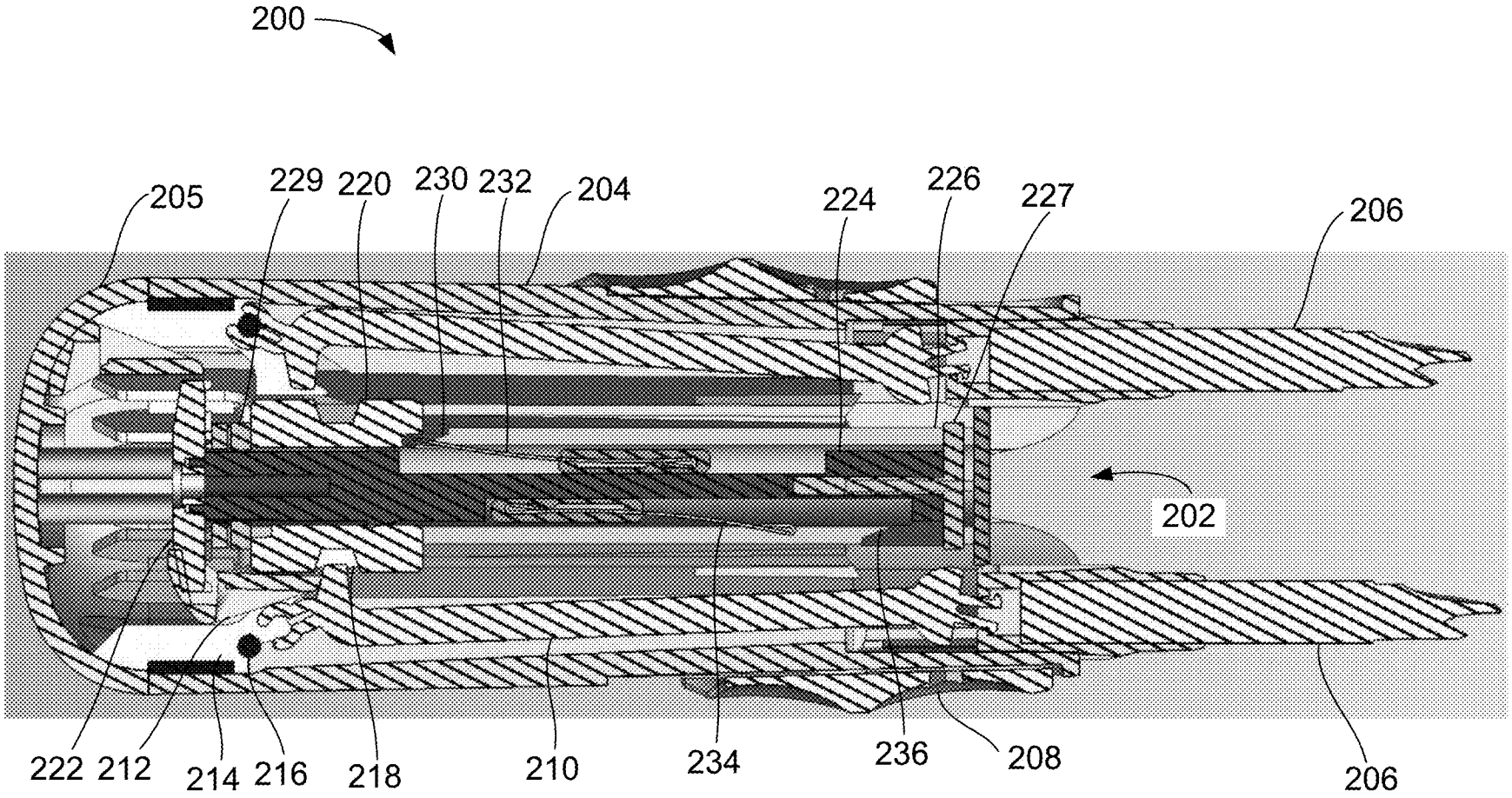
FIG. 10 is a cross-section view of the spring driven actuation mechanism of FIG. 9 in an intermediate position.
Figure 11:
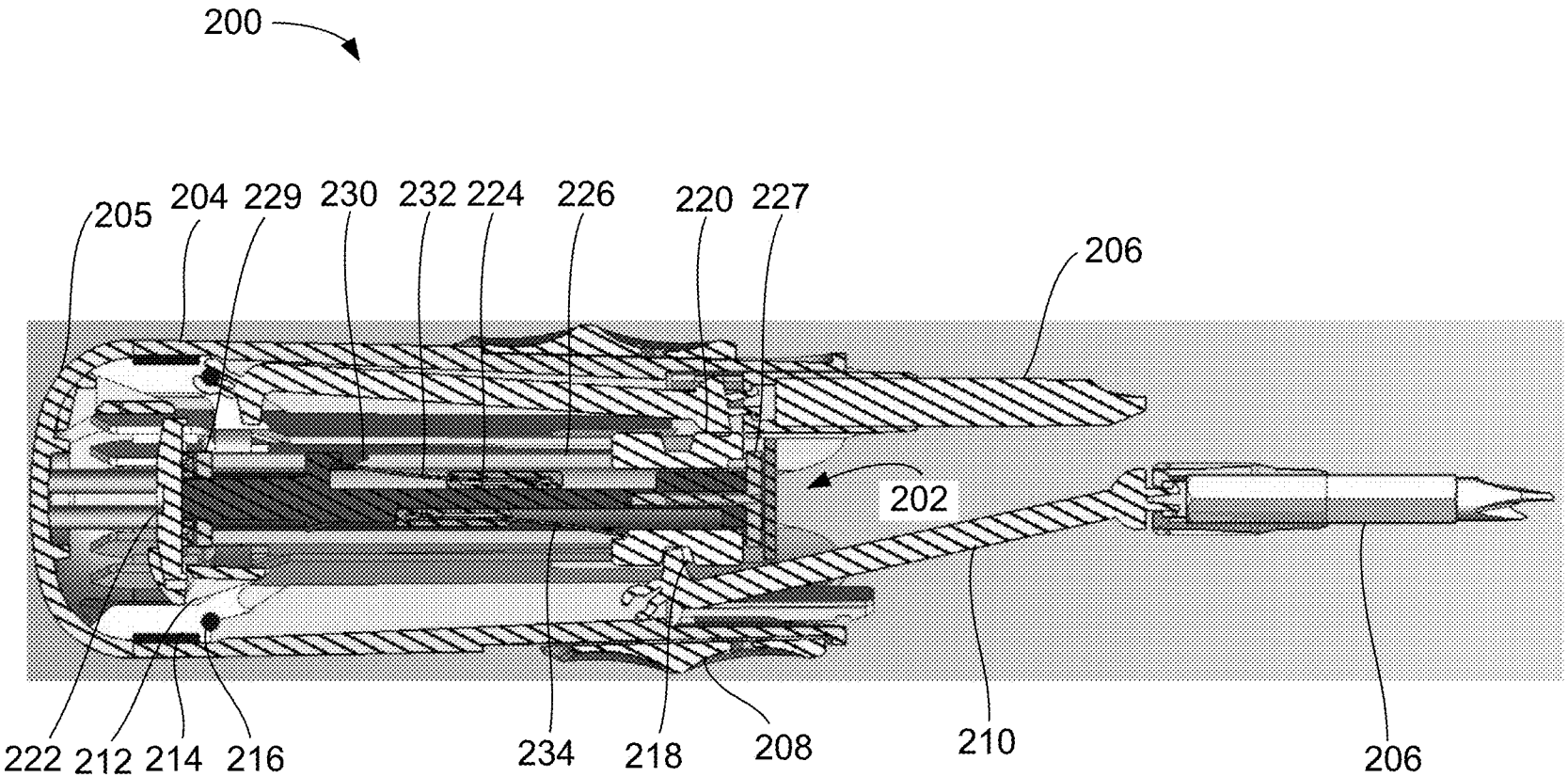
FIG. 11 is a cross-section view of the spring driven actuation mechanism of FIG. 9 in an extended position.
Figure 12:
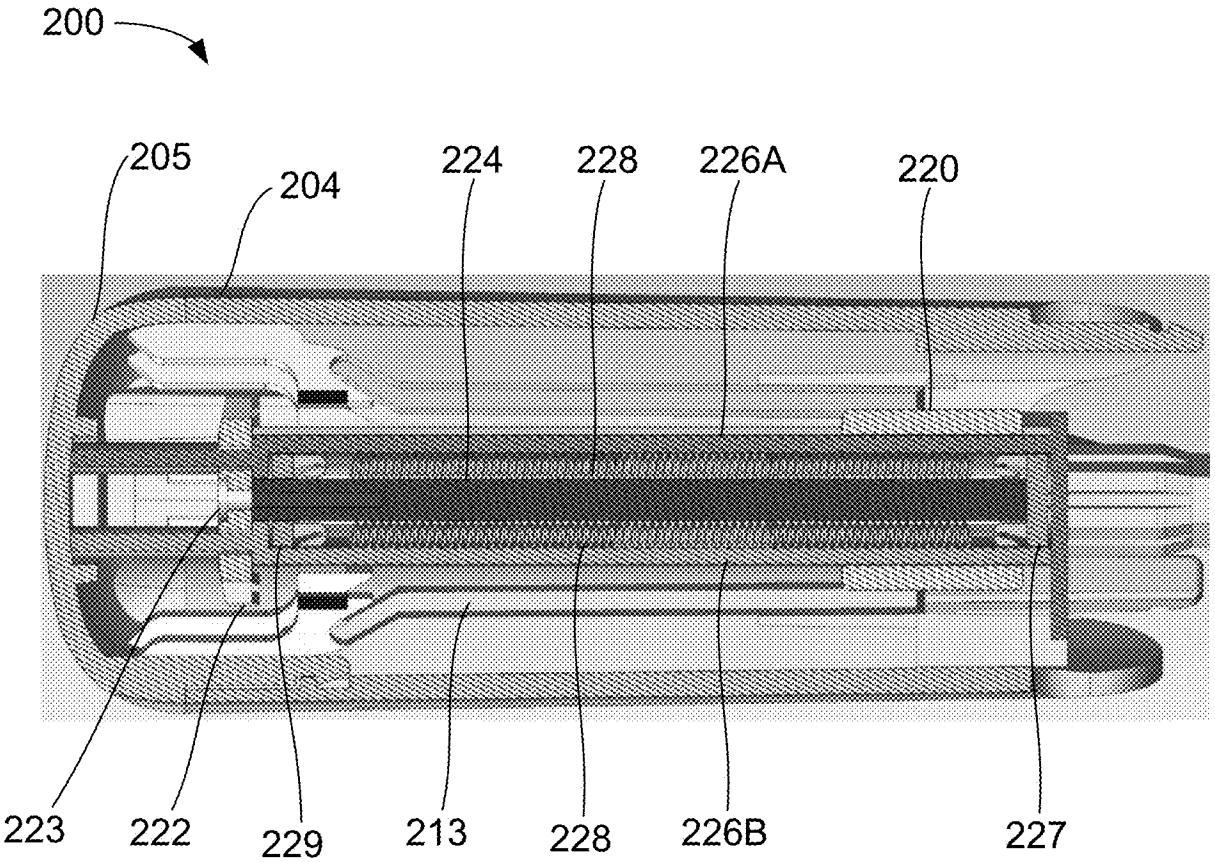
FIG. 12 is a cross-section view showing drive springs of the spring driven actuation mechanism of FIG. 9.

FIGS. 9 to 12 are multiple cut-away views of another embodiment of a handle portion of a multiple bit hand tool. In the current embodiment, the multiple bit hand tool 200 includes a spring driven actuation mechanism 202. FIGS. 9 to 11 illustrate a center cross sectional view having the chuck end removed for ease of viewing while FIG. 12 illustrates a further cross sectional view having a chuck end and extended bit removed. The figures reflect the motion and operation of an actuating mechanism 20 when a tool bit is being extended through the chuck for use.

The spring driven actuation mechanism 202 is housed centrally along a rotation axis within a handle body 204. The handle body 204 includes an end cap 205 for allowing for insertion and assembly of the spring driven actuation mechanism 202. The single spring driven actuation mechanism drives any and each of a plurality of tool elements 206, one at a time, to an extended/in-use position and back to a retracted/storage position. The spring driven actuation mechanism 202 may drive any of the plurality of the tool elements 206, and preferably all of the tool elements 206 of the multiple bit hand tool 200. The spring driven actuation mechanism 202 is able to extend and retract the tool elements 206 without having to manually extend the tool elements 206 and translates a small movement of an actuator button 208 into a much larger movement of the tool element 206 associated with that actuator button 208, whether that movement is extension or retraction.

To extend the tool element 206, a user actuates (e.g., slides, presses, or switches) the actuator button 208 to engage a connecting rod 210 with the spring driven actuation mechanism 202. The spring driven actuation mechanism 202 drives the connecting rod 210 forward associated with a tool element 206 into the extended position.

To retract the tool element 206, the user actuates (e.g., slides, presses, or switches) the actuator button 208 to pull the connecting rod 210 and tool element rearward 206. Once the tool element 206 is retracted, the spring driven actuation mechanism 202 disengages from the connecting rod 210 of that particular tool element 206. The spring driven actuation mechanism 202 may then be engaged by any one of the tool elements 206 selected by the user.

Beginning from a retracted position (FIG. 9), for extension, a user pushes the actuator button 208 forward for a selected one of the tool elements 206. The actuator button 208 pulls forward a channel guide 212 which removes the connecting rod 210 from an actuator rest 214. The channel guide 212 rides on runners 213 on an inner surface of the body 204. The channel guide 212 urges the connecting rod 210 off of a rest pin 216 of the actuator rest 214 and into a cavity 218 of a spring collar 220. The connecting rod 210 for the selected tool element 206 is now engaged with the spring collar 220 and in an intermediate position as schematically shown in FIG. 10.

With the same actuation of the actuator button 208, the channel guide 212 pushes an actuator lockout 222 forward. The actuator lockout is attached (e.g., by fastener 223) to an internal shaft 224 to slide the internal shaft 224 forward. The internal shaft 224 slides inside an external shaft 226 (having two components 226A, 226B shown in FIG. 12) to push a distal spring connector 227 and stretch a drive spring 228. The drive spring or springs 228 (e.g., a helical extension spring) is loaded in tension providing a pull force, opposing extension. A proximal end of the drive spring 228 is attached to a proximal spring connector 229 and the distal end of the drive spring 228 is attached to the distal spring connector 227. The distal spring connector 227 slides with respect to the internal shaft 224 within the external shaft 226 and, in the extended position, contacts the spring collar 220. The proximal spring connector 229 slides with respect to the internal shaft 224 and, in the retracted and intermediate positions, contacts the spring collar 220.

A first tapered section 230 on the internal shaft 224 releases a retract leaf spring 232. The retract leaf spring is attached to the external shaft 226 and is biased outward. The retract leaf spring 232 is released from contacting the spring collar 220. The drive spring 228 then pulls the proximal spring connector 229 and the spring collar 220 is launched forward. The spring collar 220 slides freely on an outer surface of the external shaft 226 to propel the tool element 206 to the extended position (FIG. 11). In the extended position, an extended leaf spring 234, biased outward and attached to the external shaft 226, holds the spring collar 220 in place. The tool element 206 passes through an opening in the chuck (not shown) and is now in the extended and in use position.

In the extended position the actuator lockout 222 stops non-selected tool elements 206 from being actuated by blocking the channel guides 212 of non-selected actuator buttons 208.

The tool element 206 may be locked in the extended position by the extend leaf spring 234 or with another locking mechanism such as the locking collar 17 of FIGS. 1 to 8.

For retraction, a user pushes the actuator button 208 rearward. The actuator button 208 pulls the actuator lockout 222, internal shaft 224, and proximal spring connector 229 rearwardly stretching and pulling the drive spring 228. A second tapered section 236 on the internal shaft 224 releases the extend leaf spring 234 from contacting the spring collar 220. The drive spring 228 then pulls the distal spring connector 227 to propel the spring collar 220 rearward to the intermediate position (FIG. 10) where the retract leaf spring 232 holds the spring collar 220 in place. The connecting rod 210 is urged by the channel guide 212 out of the cavity 218 of the spring collar 220 and onto the rest pin 216 of the actuator rest 214. The tool element 206 is then back in the retracted and stored position (FIG. 9).

Where there is one spring actuation mechanism 202 for multiple tool elements 206 there may be a reduction of components. Less moving parts and springs may lead to a simplified manufacture and assembly and a longer life of the hand tool 200. As the spring actuation mechanism 202 is a central mechanism with an actuator lockout 222, only one tool element 206 is selectable at a time which may reduce jamming.

FIGS. 9 to 12 illustrate one way in which the spring driven actuation mechanism could be installed. The disclosure is not limited to this specific configuration. One particular possible variation is that the spring driven actuation mechanism.

In an embodiment, the spring driven actuation mechanism 202 may be used in place of the actuating mechanism 20 of the multiple bit hand tool 10 of FIG. 1 such that the multiple bit hand tool 10 has both the release cam 40 and locking collar 17 as described with reference to FIGS. 1 to 8 and the spring driven actuation mechanism 202 as described with reference to FIGS. 9 to 12. In this case, the locking collar 17 is in the chuck and does not interfere with the operation of the spring driven actuator 202 thus providing a central spring driven actuation mechanism with a hands-free chuck based locking collar. The locking collar 17 provides in-chuck locking reducing or preventing axial stress on the spring driven actuation mechanism 202 (e.g., the extend leaf spring 234).

It will be appreciated that the above description relates to the preferred embodiments by way of example only. Many variations on the disclosure will be obvious to those knowledgeable in the field, and such obvious variations are within the scope of the disclosure as described, whether or not expressly described. For example, the size of the hand tool may be varied to suit different applications such as pocket screwdrivers or higher torque screwdrivers. Screwdriver bits may be replaced by a pen/pencil or scribing tip, or other non-screwdriver bits, which are retractable into the housing similar to the screwdriver bits described above. A common application of the disclosure will be as a screwdriver, with the elements being screwdriver bits, but the disclosure is not limited to that.

In the preceding description, for purposes of explanation, numerous details are set forth in order to provide a thorough understanding of the embodiments. However, it will be apparent to one skilled in the art that these specific details are not required. The above-described embodiments are intended to be examples only. Alterations, modifications and variations can be effected to the particular embodiments by those of skill in the art without departing from the scope, which is defined solely by the claims appended hereto.

What is claimed is:

1. A multiple bit hand tool comprising:

a handle body portion;

a set of actuation mechanisms;

a set of tool bits, each tool bit associated with one of the set of actuation mechanisms;

a chuck portion including a locking collar mounted to the handle body portion and an aperture for receiving a tool bit in an extended position;

wherein the locking collar includes a latch portion including a set of latch arms, each latch arm having a bit end cap contact and a release cam contact;

whereby when a tool bit is extended through the locking collar, the bit end cap contact abuts the tool bit to protect against retraction of the tool bit and the release cam contact abuts the associated actuation mechanism.

2. The multiple bit hand tool of claim 1 wherein each latch arm further comprises an angled surface corresponding to a chuck portion angled surface.

3. The multiple bit hand tool of claim 1 wherein the handle body portion comprises:

a handle portion; and a body portion.

4. The multiple bit hand tool of claim 3 wherein the handle portion includes a plurality of slats, each of the slats including grooves on either side of the slat; and the body portion includes a plurality of flanges, each of the flanges including protrusions on either side of the flanges.

5. The multiple bit hand tool of claim 4 wherein when the handle portion and the body portion are connected, the protrusions and the grooves mate to provide a friction fit handle for the multiple bit hand tool; and wherein the connection of the protrusions and grooves provide slots whereby the set of actuating mechanism slide.

6. The multiple bit hand tool of claim 1 wherein a number of actuating mechanisms equals a number of tool bits.

7. The multiple bit hand tool of claim 1 wherein the chuck portion comprises a cross-section corresponding to a cross-section of each of the set of tool bits.

8. The multiple bit hand tool of claim 1 wherein each of the set of actuation mechanisms comprises an arm portion and a tool bit portion.

9. The multiple bit hand tool of claim 8 wherein the arm portion comprises:

an actuation button;

a connecting rod; and a release cam.

10. The multiple bit hand tool of claim 9 wherein the release cam contact abuts the release cam when the tool bit is in the extended position.

11. The multiple bit hand tool of claim 1 wherein each of the set of actuation mechanisms is a single spring driven actuation mechanism.

* * * * *